United States Patent [19]

Lazaridis

[11] 4,023,558

[45] May 17, 1977

[54] WATER HEATER

[75] Inventor: Lazaros J. Lazaridis, Lincoln, Mass.

[73] Assignee: Thermo Electron Corporation, Waltham, Mass.

[22] Filed: July 28, 1975

[21] Appl. No.: 599,736

[30] Foreign Application Priority Data

July 31, 1974 United Kingdom ..... 33810/74

[52] U.S. Cl. ..... 126/391; 110/97 D; 122/156; 126/350 R

[51] Int. Cl.[2] ..... F22B 7/00

[58] Field of Search ..... 122/155 A, 156; 110/97 D; 138/42, 43; 237/8 R; 126/361, 364, 367, 391, 350

[56] References Cited

UNITED STATES PATENTS

| | | | |
|---|---|---|---|
| 941,618 | 11/1909 | Churchill | 110/97 D |
| 1,101,872 | 6/1914 | Meacham | 122/156 |
| 3,257,076 | 6/1966 | Laing et al. | 237/8 |

FOREIGN PATENTS OR APPLICATIONS

| | | | |
|---|---|---|---|
| 23,540 | 4/1904 | Germany | 126/350 |
| 17,516 | 7/1910 | United Kingdom | 122/155 A |

*Primary Examiner*—John J. Camby
*Assistant Examiner*—Larry I. Schwartz
*Attorney, Agent, or Firm*—James L. Neal; David W. Gomes

[57] ABSTRACT

A water heater has a hot gas conduit forming a heat transfer wall enclosed by a water jacket. A series of baffles within the conduit direct jets of hot gases to impinge upon the heat transfer wall. The baffles thermally expand during operation to engage the heat transfer wall, but are removable as a unit for servicing when the heater is cool.

1 Claim, 4 Drawing Figures

WATER HEATER

This invention relates to an improved heater for a fluid such as, for example, water.

There are numerous forms of water heater and other fluid heaters required in the ordinary events of today's life. For example, the use of hot water circulated around the various rooms of a house or other building is one of the preferred methods of central heating. For such purposes, it is usual to heat water to a temperature well above room temperature, but below boiling point, and to circulate it to heating units arranged throughout the house. A centrally located water heater is arranged to heat a central water supply, usually without substantial storage capacity. When the house is too cool, there is a demand for additional hot water, and when the house is at the required temperature, this demand temporarily ceases. For the centralized water heater, is is desirable to have a heater which is as compact as possible, as inexpensive as possible, and as efficient as possible. Ordinarily, this heating unit takes the form of a familiar burner for oil, gas or coal plced in a utility location in the house. It is relatively large and bulky and, in general, operates at or below about 80% efficiency, and an increase in efficiency is highly advantageous. A hot water heating system has a number of advantages. In particular, a hot water heating system is the simplest to install when an existing structure is modernized by fitting central heating or when another form of central heating is installed in an existing structure to replace an earlier form.

Home heating or industrial space heating is not the only need for a demand supply of hot water or other fluid. Many industrial uses require a supply of hot water on essentially a demand basis. Typical such uses and applications include various industrial systems such as, for example, commercial and industrial laundries.

In addition to the traditional needs for a demand supply of hot water, there are a number of new needs for water heating systems. For example, in recent years, there has been a rapid rise in the use and installation of public and private swimming pools and other similar uses of water, heated only a little above its normal temperature. In a typical swimming pool, for example, a relatively large body of water, which might be in an amount of tens of thousands of gallons, is maintained at a temperature usually between about 75° F and about 80° F. Except in very hot summer weather, the maintenance of such a temperature requires a substantial amount of heat which is again required on a demand basis. The pool, itself, is the storage tank. Heaters are available for such purposes, but there is substantial room for improvement. For example, such water heaters are generally relatively large and bulky and are usually unsightly. It is usual to place such heaters in an out-of-the-way location, usually in an enclosed space to protect them from exposure and also to hide them from the eye.

According to this invention a fluid heater comprises an elongated jacket having an inner wall and an outer wall and means to allow a fluid to be heated to pass between the walls, a source of hot gas, a conduit at least partly bounded by the inner wall to convey hot gas from the source through the heater, the inner wall being the sole and direct means of separation between the fluid and the hot gas, a plurality of baffles within the conduit positioned to divide the conduit into a plurality of compartments arranged sequentially one behind the other in the conduit, the baffles in each compartment being arranged to receive gas from a previous compartment and to direct the gas substantially normally towards the inner wall.

Preferably the inner and outer walls are substantially cylindrical and, in this case, the baffles are top-hat shaped and extend across the entire width of the conduit, each baffle having apertures in the side wall of its crown for directing the hot gas normally towards the inner wall.

The source of hot gas may be a forced combustion burner assembly. The external structure of the heater may be a decorative cylinder adapted to be mounted upright and form a decorative part of a recreation area.

A heater in accordance with this invention having a length of five feet, an input of about 200,000 BTU's per hour, and four baffles has been found to produce an operating efficiency of about 85%.

Hot gases passing through the internal compartments of the heater and the fluid flowing through the jacket may flow in either direction, but preferably the fluid through the jacket and the hot gases flow in countercurrent.

A particular example of a heater in accordance with this invention, and modifications of the heater will now be described with reference to the accompanying drawings in which.

Figure 1:
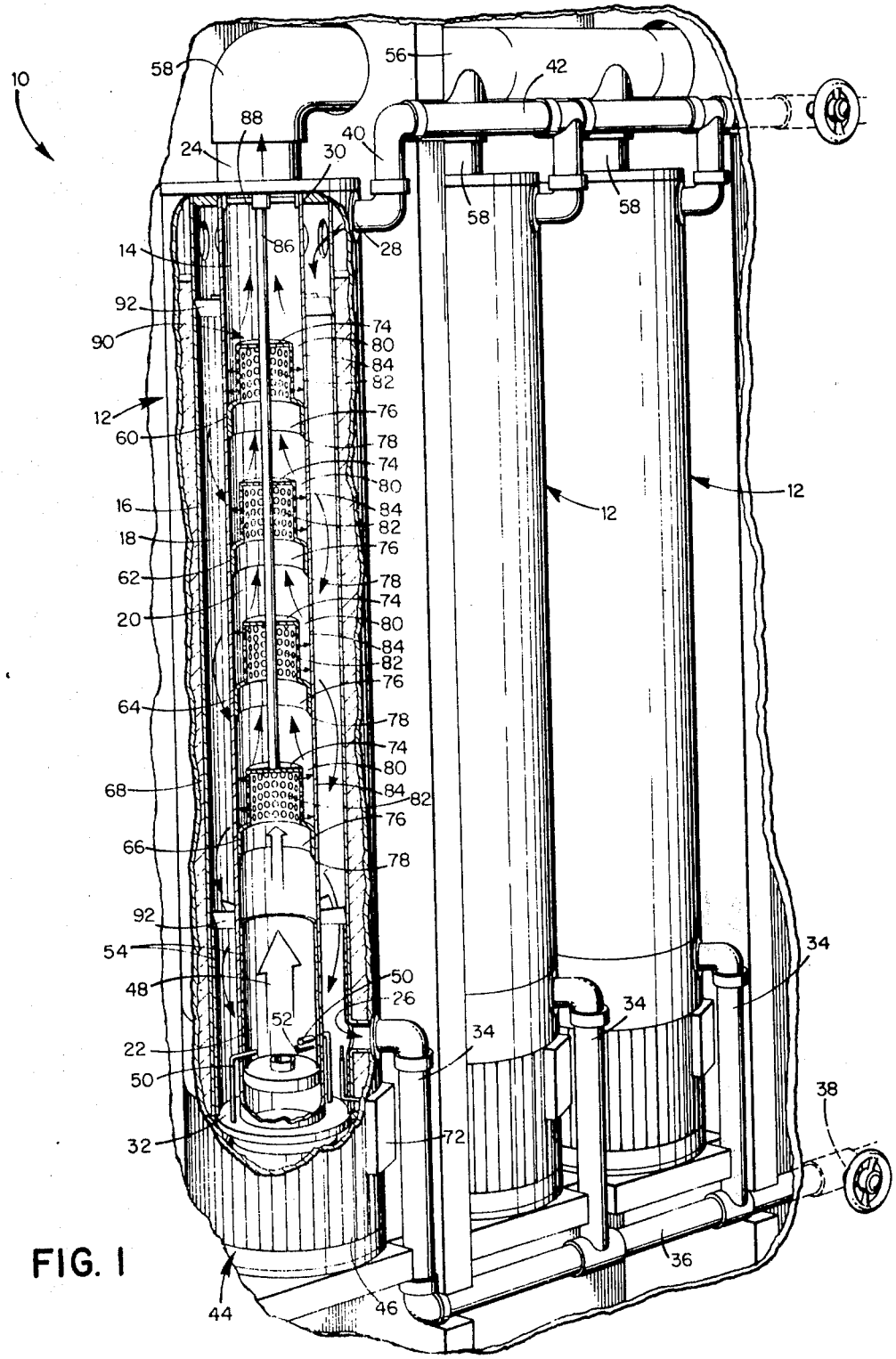
FIG. 1 is a partially sectioned perspective view of a heating unit.

The heating unit now being described is intended to be used to heat water and comprises three individual heaters 12. Each heater 12 consists of two concentric tubes, an inner tube 14 and an outer tube 16. Around the outer tube 16 is a layer of insulation 68. The tubes 14 and 16 bound an annular jacket 18 between them and an interior conduit 20 is bounded by the inner tube 14. The interior conduit 20 is arranged so that relatively hot combustion gases flow from its inlet end 22 to its outlet end 24 from which the combustion gases are vented to exhaust. The jacket 18 includes an inlet port 28 through which a relatively cool flow of water enters the jacket, and an outlet port 26 through which relatively hot water leaves. A portion of the inner tube 14 forms a heat exchange wall 70 having heat exchange surfaces along both sides thereof for the transfer of heat from the combustion gases in the interior conduit 20 to the relatively cool water in the jacket 18. The outer tube 16 is attached and sealed to the inner tube 14 by members 30 and 32 to complete the jacket.

In use, water is fed to the inlet port 28 of each heater 12 from a cold water supply source by a feed pipe 40 which is connected to a main water pipe 42. The water flow to all the heaters 12 may be controlled by a valve 38. Water is taken from the outlet port 26 of each heater 12 through a hot water feed pipe 34 which connects with a main hot water pipe 36 connecting all the heaters 12. Although this example shows 28 as the inlet port and 26 as the outlet port, each heater 12 would also function if the parts were reversed and if the water flow were reversed.

Hot combustion gases are supplied to the inlet end 22 of the conduit by a forced combustion system 44. The forced combustion system 44 consists of a temperature sensor (not shown) for activating it when the temperature of water in the jacket 18 falls below a predetermined value, a blower 46, a burner 48 located within the inner tube 14, fuel inlets 50, an igniter 52, and insulation 54 surrounding the burner 48 which retains heat from the burning gases within the interior conduit 20. The hot combustion gases are exhausted from each heater 12 through the oulet end 24 by means of a single exhaust vent 56 which is of about the same diameter as the inner tube 14, and which is connected to each unit 12 by means of connecting vents 58. A pre-mixed forced combustion system or other means of generating a flow of hot gas may also be used. In such a system, air and fuel is forced by the blower into the combustion chamber where it is ignited. The mixing of fuel and air may be, for example, prior to its entry into the blower or within the combustion chamber.

The interior conduit 20 contains a longitudinally stacked series of perforated baffles 60, 62, 64, 66, coaxial with and wholly contained within the inner tube 14. The total number of baffles used in series depends on the requirements of the water heater and four baffles are used in this example. The baffles 60, 62, 64, 66 are generally top-hat shaped with their closed ends 74 towards the outlet end 24 of the interior conduit 20, and their open ends 76 facing the inlet end 22. The open end 76 of each baffle includes a protruding lip or brim 78 which expands thermally and tightly engages the heat exchange wall 70 during the operation of the forced combustion system 44. This lip or brim 78 prevents gases entering the space 80 between the baffle and the heat exchange wall 70 except through openings 82 in the side walls 84 of the crowns of the baffles. The openings 82 are shaped to direct a number of jets essentially normally towards and to impinge on the heat exchange wall 70.

In this example the heat exchange rates are a function of the pressure drop from the inlet end 22 to the outlet end 24, which, in turn, functionally relates to the number of baffles, the size of the jets, and other design parameters which are selected to produce optimum results for each particular purpose.

The baffles 60, 62, 64, 66 are arranged within the interior conduit 20 so that the distance between the closed end of one baffle and the open end of the next baffle is sufficient to permit an unimpeded flow of gases between the baffles without any discernable loss of pressure. The baffles 60, 62 and 64 are secured to a rod 86 passing through a hole in their closed ends 74 and extending through the baffles along their longitudinal axis. The rod terminates at the closed end 76 of the baffle 66 where it is securely attached.

The baffles 60, 62, 64, 66 may be held in place in one of several ways. They may be welded to the rod 86 as shown in FIG. 1, or they may rest on cylindrical spacer sleeves which surround the rod and are slightly larger in diameter than the rod. The end of the rod 86 which faces the outlet end 24 of the interior conduit 20 is attached to the inner tube 14 by means of a spider 88. The spider 88 is either welded or bolted to the wall of the inner tube 14. The entire baffle assembly, including elements 60, 62, 64, 66 and 86 which are hereafter designated assembly 90, may be renoved for cleaning, repair or replacement. When the water heater 12 is not in operation, the protruding lips 78 of each baffle contract and the assembly is supported only by the spider 88. Thus, if the spider 88 is removed, or if the rod 86 is removed from the spider 88, the entire baffle assembly 90 is easily extracted. The individual baffles 60, 62, 64, 66 may then be separated and the various parts cleaned or replaced.

The jacket 18 contains one or more sets of vanes 92 near its inlet port 26 for imparting a helical flow to the water in the jacket, about the inner tube 14. These vanes 92 are arranged at a slight angle to the longitudinal axis of the inner tube 14 and extend radially outwardly from the heat exchange wall 70 to the outer tube 16. A helical flow path is desirable, since the water passes in a less direct path from the inlet port 26 to the outlet port 28 and is more uniformly mixed or agitated. Preferably fins 71 fixed to the wall 70 and in the jacket 18 are used to increase the heat exchange between the wall 70 and the water in the jacket.

In operation, water enters the jacekt 18 through the inlet port 26 and passes between the vanes 92 during which it acquires a helical motion, circulating about the inner tube 14. As the water circulates it passes in heat exchange relationship with the heat exchange wall 70 and becomes heated. As required, hot water is withdrawn from the outlet port 28 into the hot water feeder pipe 26. Once the temperature of the water in the exterior conduit 18 falls below the predetermined value, the forced combustion system 44 is activated by the temperature sensor. Air is injected into the burner 48 under pressure from the blower 46 and mixed with fuel from the fuel inlet 50. The fuel and air mixture is ignited by the igniter 52. Because the air stream enters the burner 48 under pressure, the burning gases are forced up into the interior conduit 20 where the combustion may continue. The blower 46 also serves to maintain the required pressure at the inlet end 22 to establish a differential between the inlet end 22 and the outlet end 24 odf the interior conduit 20. These combustion gases first enter the baffle 60 through its open end 76. The gases are then forced through the openings 82 and are directed to impinge in jets on the heat exchange wall 70, transferring heat from the combustion gases to the heat exchange wall 70 and from the wall 70 to the water in the jacket 18. Once having impinged on the heat exchange wall 70, the gases flow upward toward the open end 76 of the baffle 62 where the process is repeated. Eventually the gases are exhausted through the vent 56. Heat losses from the forced combustion system 44 are minimised by surrounding it with the insulation 54 and the hot gas conduit 20 with the water jacket 18.

Figure 3:
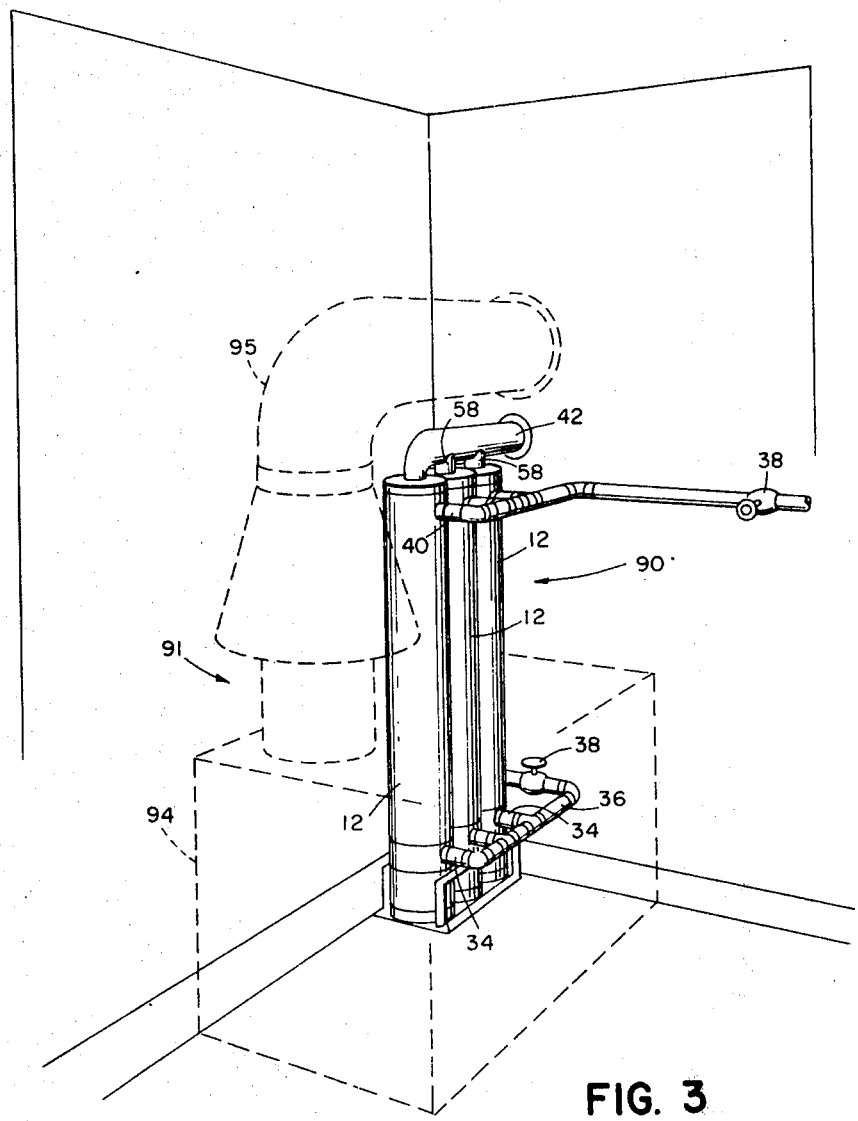
FIG. 3 is a perspective view of the heating unit and shows a comparable conventional heater for comparison; and, FIG. 4 is a perspective view of a heater modified to form an out-of-doors heating unit.

This invention provides an efficient, highly compact water heater. For example, each heater 12 depicted in the FIGS. 1 and 3 is about 7 inches in diameter including the layer of insulation 68, the exhaust vent is about 3 inches in diameter, and the length of each unit is about 60 inches not including the hot water feed pipe 40, the cold water feed pipe 34, or the exhaust vent 56. Each heater 12 has an input of 200,000 BTU's per hour and is capable of augmenting the other. Thus, 3 units have an approximate capacity of 10½ gallons per minute with a 100° F temperature rise. One heater 12 would suffice for use in a large dwelling, while multiple units 12 could be arranged for industrial use. A heater of this type has been found to have an efficiency of about 85%. The small size of each unit 12 permits the water heater 10 to be plced in otherwise unusable space, such as vertically between the walls of a building, as shown in FIG. 1, or horizontally between floor joints without wasting valuable space elsewhere. The heater in this example is multi-poised, that is to say, it may be oriented in any direction. The heaters may be inverted so the burner and forced combustion system is at the top, arranged horizontally, or if the occasion requires, inclined.

In FIG. 3 is shown a heating system generally designated 90, in accordance with this invention, superimposed upon a conventional heater shown in dotted lines and designated generally 91, which has a similar capacity. The heating unit shown in FIG. 3 includes three heaters 12 mounted on a base or support 93. A cold water feeder pipe 40 leads into each heater from a main water pipe 42 and individual hot water feeder pipes 34 lead out of each heater to a main hot water pipe 36. A connecting vent 58 leads from each unit 12 to a main exhaust vent 56, which is appropriately connected to direct exhaust gases through an exhaust system in the house or other building. Ordinarily the exhaust vent will lead to a chimney.

As indicated in FIG. 3, the system, according to the present invention may be made considerably smaller than a similarly rated conventional unit 91, which usually comprises, for example, boiler 94 with a large exhaust pipe 95.

Figure 2:
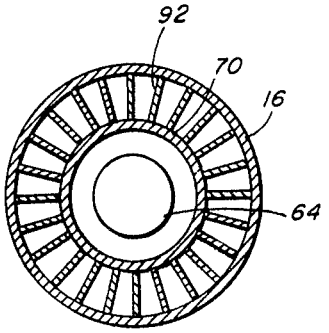
FIG. 2 is a cross-section of one heater of the heating unit shown in FIG. 1.
Figure 4:
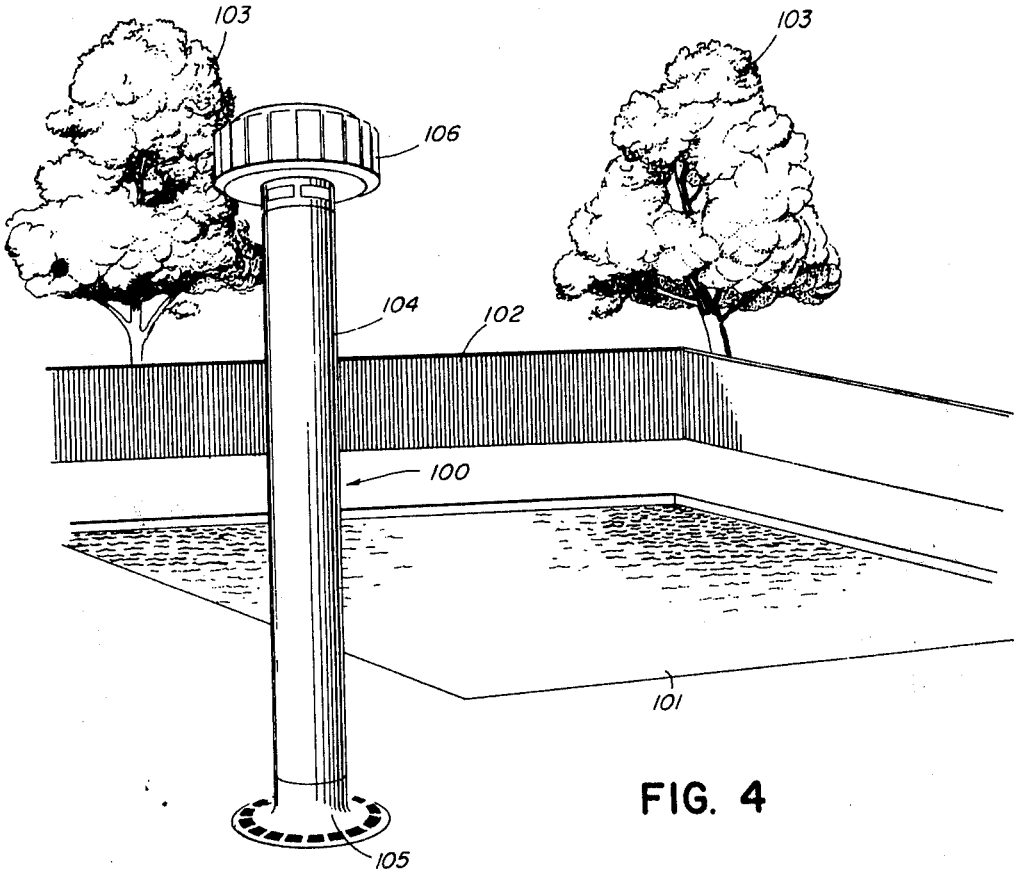

FIG. 4 illustrates an outdoor water heater, generally designated 100, positioned beside a swimming pool 101. The pool 101 may be decorated by and protected by the fence 102 and by other decorative articles or landscaping objects, such as, for example, trees 103. The heater, according to this modification of the invention includes a single vertical cylinder or pole 104 whithin which are contained the heaters which may be for example, the heaters illustrated in FIG. 1 and FIG. 2. A decorative base support 105 and a decorative header 106 complete the structure. In this modification the header 106 is a decorative lamp fixture. The entire heating unit 100, as can be seen, is designed to blend into the combination pool and landscaping. All of the hot parts and components of the system are wholly internal and the external parts which are exposed and may be touched by a human being need be no warmer than the temperature to which the water is heated.

Thus a fluid heater in accordance with the present invention, is particularly well suited to solve the problems of all of the various types of heating requirements. It is a simple, compact heating system occupying a fraction of the space previously occupied by existing water heaters. The essential parts and components of the heater are small in size and reliable and adaptable to decorative installation. In a central heating unit for heating a house or other building, it is small, efficient, and compact. It generally operates at approximately 85% efficiency instead of at or below 80% efficiency and higher efficiencies may be achieved. The heating components, including the elements containing the burning gases are essentially within the heater so that a minimum of insulation is required to protect the heater against heat loss and to protect human occupants of the dwelling space from painful and dangerous burns. In commercial water heating installations, the same advantages are achieved.

I claim:

1. A water heater, comprising:

an elongated cylindrical annular water jacket to be vertically disposed and having an inner wall and an outer wall and means to circulate water through said jacket from the top of said jacket to the bottom;

a source of forced hot gas;

a conduit formed by said inner wall for conveying hot gas from said source through the heater from the bottom to the top thereof, said inner wall being the sole and direct means of separation between the water and the hot gas and thereby forming a heat transfer wall;

a series of baffles centrally disposed within said conduit positioned to divide said conduit into a plurality of sections disposed longitudinally and sequentially in said conduit, said baffles being cylindrically shaped and smaller in diameter than said conduit, the wall of each said cylindrical baffle being substantially parallel to said inner wall, said baffle having a closed end disposed towards the top of said heater and an open end disposed towards the bottom of said heater, said baffles also having an outwardly protruding lip at the bottom thereof for sealing engagement with said inner wall only by thermal expansion of said baffle during the operation of said heater;

the wall of each baffle having a predetermined number of apertures for forming impingement jets of hot gas and for directing said jets substantially perpendicular against said inner wall, wherein the apertures in each baffle represent the sole means of gaseous communication between sequential sections;

a rod connected to said baffles for unitary removal thereof during the servicing of said heater; and a plurality of vanes within said jacket for deflecting water flow within said jacket for lengthening the path traveled by water within the jacket.

* * * * *